US007303654B2

(12) United States Patent
Tokarz et al.

(10) Patent No.: US 7,303,654 B2
(45) Date of Patent: Dec. 4, 2007

(54) CELLULOSIC PRODUCT AND PROCESS FOR ITS PRODUCTION

(75) Inventors: Marek Tokarz, Kungälv (SE); Jerker Nilsson, Göteborg (SE)

(73) Assignee: AKZO Nobel N.V., Arnhem (NL)

( * ) Notice: Subject to any disclaimer, the term of this patent is extended or adjusted under 35 U.S.C. 154(b) by 376 days.

(21) Appl. No.: 10/717,276

(22) Filed: Nov. 18, 2003

(65) Prior Publication Data

US 2004/0140074 A1 Jul. 22, 2004

Related U.S. Application Data

(60) Provisional application No. 60/427,618, filed on Nov. 19, 2002.

(51) Int. Cl.
*D21H 11/00* (2006.01)

(52) U.S. Cl. ..... 162/181.8; 162/158; 162/164.1; 162/168.3; 162/123; 162/132; 428/153

(58) Field of Classification Search ..... 162/181.8, 162/158, 164.1, 168.3, 123, 132, 100; 428/153
See application file for complete search history.

(56) References Cited

U.S. PATENT DOCUMENTS

| | | | | |
|---|---|---|---|---|
| 4,070,236 | A | 1/1978 | Carrard et al. | 162/164 R |
| 4,388,150 | A | 6/1983 | Sunden et al. | 162/175 |
| 4,753,710 | A | 6/1988 | Langley et al. | 162/164.3 |
| 4,913,775 | A | 4/1990 | Langley et al. | 162/164.3 |
| 4,927,465 | A | 5/1990 | Hyder et al. | 106/486 |
| 4,927,498 | A | 5/1990 | Rushmere | 162/168.3 |
| 4,954,220 | A | 9/1990 | Rushmere | 162/168.3 |
| 4,961,825 | A | 10/1990 | Andersson et al. | 162/175 |
| 4,980,025 | A | 12/1990 | Andersson et al. | 162/168.3 |
| 5,015,334 | A | 5/1991 | Derrick | 162/168.1 |
| 5,037,508 | A | 8/1991 | Hyder et al. | 162/181.2 |
| 5,071,512 | A | 12/1991 | Bixler et al. | 162/175 |
| 5,098,520 | A | 3/1992 | Begala | 162/168.1 |
| 5,127,994 | A | 7/1992 | Johansson | 162/168.3 |
| 5,176,891 | A | 1/1993 | Rushmere | 423/328.1 |
| 5,185,062 | A | 2/1993 | Begala | 162/168.1 |
| 5,368,833 | A | 11/1994 | Johansson et al. | 423/338 |
| 5,378,367 | A | 1/1995 | O'Neill et al. | 210/669 |
| 5,399,537 | A | 3/1995 | Bhattacharyya et al. | 502/84 |
| 5,447,604 | A | 9/1995 | Johansson et al. | 162/181.6 |
| 5,470,435 | A | 11/1995 | Rushmere et al. | 162/181.6 |
| 5,534,057 | A | 7/1996 | Harrison et al. | 106/486 |
| 5,543,014 | A | 8/1996 | Rushmere et al. | 162/181.6 |
| 5,571,379 | A | 11/1996 | Derrick | 162/168.1 |
| 5,571,494 | A | 11/1996 | Saastamoinen | 423/338 |
| 5,573,674 | A | 11/1996 | Lind et al. | 210/702 |
| 5,584,966 | A | 12/1996 | Moffett | 162/168.1 |
| 5,603,805 | A | 2/1997 | Andersson et al. | 162/168.3 |
| 5,607,552 | A | 3/1997 | Andersson et al. | 162/181.6 |
| 5,688,482 | A | 11/1997 | Saastamoinen | 423/335 |
| 5,707,493 | A | 1/1998 | Saastamoinen | 162/164.1 |
| 5,755,930 | A | 5/1998 | Satterfield et al. | 162/164.1 |
| 5,858,174 | A | 1/1999 | Persson et al. | 162/164.1 |
| 6,113,741 | A | 9/2000 | Kettunen et al. | 162/158 |
| 6,468,488 | B1 | 10/2002 | Stamires et al. | 423/239.1 |
| 6,593,265 | B2 | 7/2003 | Stamires et al. | 502/73 |
| 2002/0110520 | A1 | 8/2002 | Stamires et al. | 423/600 |
| 2002/0124979 | A1 | 9/2002 | Ovenden et al. | 162/158 |
| 2005/0257909 | A1 * | 11/2005 | Lindgren et al. | 162/181.2 |

FOREIGN PATENT DOCUMENTS

| | | |
|---|---|---|
| GB | 1 375 161 | 11/1974 |
| GB | 2 297 334 A | 7/1996 |
| JP | 09-095900 | 4/1997 |
| WO | WO 86/05826 A1 | 10/1986 |
| WO | WO 89/03863 A1 | 5/1989 |
| WO | WO 89/06294 A1 | 7/1989 |
| WO | WO 95/21295 A1 | 8/1995 |
| WO | WO 95/21296 A1 | 8/1995 |
| WO | WO 97/33040 A1 | 9/1997 |
| WO | WO 99/41195 A1 | 8/1999 |
| WO | WO 99/41196 A1 | 8/1999 |
| WO | WO 99/41197 A1 | 8/1999 |
| WO | WO 99/41198 A1 | 8/1999 |
| WO | WO 99/55962 A2 | 11/1999 |
| WO | WO 99/55962 A3 | 11/1999 |
| WO | WO 99/55964 A1 | 11/1999 |
| WO | WO 99/55965 A1 | 11/1999 |
| WO | WO 99/67310 A1 | 12/1999 |
| WO | WO 00/44671 A1 | 8/2000 |
| WO | WO 00/44672 A1 | 8/2000 |
| WO | WO 00/49227 A1 | 8/2000 |

(Continued)

OTHER PUBLICATIONS

International Search Report for International Application No. PCT/SE 03/01727 dated Mar. 4, 2004.

Iler et al., "Degree of Hydration of Particles of Colloidal Silica in Aqueous Solution," J. Phys. Chem., vol. 60, (1956), pp. 955-957.

Huges, Sr., D. A., "A method for determining the pitch adsorption characteristics of mineral powders," Tappi, vol. 60, No. 7 (Jul. 1977), pp. 144-146.

English language translation of Japanese Laid-Open No. 1985-94687; laid-open date May 27, 1985.

(Continued)

*Primary Examiner*—Mark Halpern
(74) *Attorney, Agent, or Firm*—Michelle J. Burke; David H. Vickrey; Robert C. Morriss

(57) ABSTRACT

The present invention relates to a process for the production of a cellulosic product which comprises (i) providing an aqueous cellulosic suspension; (ii) adding to the suspension a clay having $3R_2$ stacking; and (iii) dewatering the obtained suspension. The invention also relates to a process for the production of a cellulosic product which comprises (i) providing an aqueous cellulosic suspension; (ii) adding to the suspension a cationic clay; (iii) adding to the suspension one or more drainage and retention aids comprising at least one cationic polymer; and (iv) dewatering the obtained suspension. The invention further relates to a cellulosic product comprising clay having $3R_2$ stacking.

10 Claims, No Drawings

FOREIGN PATENT DOCUMENTS

| | | | |
|---|---|---|---|
| WO | WO 01/12319 | A1 | 2/2001 |
| WO | WO 01/12542 | A1 | 2/2001 |
| WO | WO 01/12543 | A1 | 2/2001 |
| WO | WO 01/12545 | A1 | 2/2001 |
| WO | WO 01/12550 | A1 | 2/2001 |
| WO | WO 01/12570 | A1 | 2/2001 |
| WO | WO 01/40577 | A1 | 6/2001 |
| WO | WO 02/12626 | A1 | 2/2002 |

OTHER PUBLICATIONS

Derwent abstract 004336279 abstracting JP 60094687 A, 1985.

Sears, Jr., G., "Determination of Specific Surface Area of Colloidal Silica by Titration with Sodium Hydroxide," Analytical Chem., vol. 28, No. 12 (1956), pp. 1981-1983.

Patent Abstracts of Japan abstracting JP 09-095900 (2006).

Rousselot, I. et al., "Insights on the Structural Chemistry of Hydrocalumite and Hydrotalcite-like Materials: Investigation of the Series $Ca_2M^{3+}(OH)_6C1\text{-}2H_2O$ ($M^{3+}$: $Al^{3+}$, $Ga^{3+}$, $Fe^{3+}$, and $Sc^{3+}$) by X-Ray Powder Diffraction," Journal of Solid State Chemistry, vol. 167, Issue 1 (2002) pp. 137-144.

Hongjie, Z. et al., "Retention and filtration aid technology of microparticles," Journal of Tianjing Paper Making, No. 1, 2002 (marked as D2).

English language translation of Hongjie, Z. et al., "Retention and filtration aid technology of microparticles," Journal of Tianjing Paper Making No. 1, 2002 (marked as D2) 7 pages.

Qinglin, X. et al., "Several Familiar Compound Retention aid systems in Paper industry," Hellongjiang Paper Making, No. 4, 2000 (marked as D3).

Bookin, A.S. et al., "Polytype Diversity of the Hydrotalcite-Like Minerals I. Possible Polytypes and their Diffraction Features," Clays and Clay Minerals, vol. 41, No. 5 (1993) pp. 551-557.

* cited by examiner

CELLULOSIC PRODUCT AND PROCESS FOR ITS PRODUCTION

This application claims priority based on U.S. Provisional Patent Application No. 60/427,618, filed Nov. 19, 2002

The present invention relates to a process for the production of a cellulosic product which comprises treating cellulosic fibres with clay having $3R_2$ stacking, and to a process for the production of a cellulosic product which comprises treating cellulosic fibres with catonic clay. The invention also relates to a cellulosic product comprising clay having $3R_2$ stacking.

BACKGROUND OF THE INVENTION

Pulp suspensions are widely used for making cellulosic products such as, for example, pulp and paper, and contain, apart from cellulosic fibres, also compounds which have a negative impact on the production process. Such compounds are found both in cellulosic suspensions originating from virgin pulp and from recycled pulp.

In virgin pulp suspensions such disturbing/detrimental substances are primarily hemicellulose, lignin as well as lipophilic and hydrophilic extractives. Apart from the cellulose, these substances are to a varying extent dissolved or colloidally dispersed into the process waters during the pulping and bleaching operations. Compounds which are released during pulping and bleaching operations are commonly referred to as pitch. Examples of pitch include wood resins such as lipophilic extractives (fatty and resin acids, sterols, stearyl esters, triglycerides), and also fats, terpenes, terpeniods, waxes, etc.

In recycled pulp suspensions the compounds having a negative influence on the paper making process mainly consist of glues, hot-melt plastics inks and latex, just to mention a few compounds—which are commonly referred to as stickies. Apart from pitch and stickies the suspension also contains charged contaminants like salts and various wood polymers of which the charged, low charged or non-charged compounds compete with the cellulose with respect to the adsorption and interaction with added performance chemicals such as drainage and retention aids, sizing agents, etc. Usually such disturbing compounds are referred to as anionic trash.

All of the above-mentioned compounds interfere with the pulp and paper making processes in various ways. For instance, some of them precipitate due to changes in the properties of the pulp suspension and are eventually deposited on various mechanical parts of the paper machine such as, for example, screens and felts. Over time, the deposits will lead to breakdowns on the paper machine often in form of breaking of the paper web, whereby the paper machine has to be stopped for cleaning. Furthermore, paper mills tend to re-circulate the white water to a greater extent than previously, which increases the presence of disturbing and detrimental substances in the suspension.

Various additives have been used in order to decrease the negative impact of the above-mentioned detrimental/disturbing substances. For example, talc has been widely used for adsorbing pitch and stickies. Also various types of clays have been employed for reducing the impact of detrimental compounds.

Japanese laid-open patent application No. 1985-94687 relates to a pitch-adsorbing agent containing hydrotalcite.

SUMMARY OF THE INVENTION

The present invention is generally directed to a process in which cellulosic fibres are treated with a clay having $3R_2$ stacking. The present invention is also generally directed to a process in which cellulosic fibres are treated with a cationic clay. Furthermore, the invention is directed to a process for the production of a cellulosic product which comprises adding a clay having $3R_2$ stacking to an aqueous suspension containing cellulosic fibres. The present invention is further generally directed to a cellulosic product comprising a clay having $3R_2$ stacking.

The present invention further relates to a process for the production of a cellulosic product which comprises (i) providing an aqueous suspension containing cellulosic fibres: (ii) adding to the suspension a clay having $3R_2$ stacking and optionally one or more drainage (dewatering) and retention aids; and (iii) dewatering the obtained suspension. The invention further relates to a process for the production of a cellulosic product which comprises (i) providing an aqueous suspension containing cellulosic fibres; (ii) adding to the suspension cationic clay; (iii) adding to the suspension one or more drainage (dewatering) and retention aids comprising at least one cationic polymer; and (iv) dewatering the obtained suspension. The cellulosic product produced is preferably pulp and/or paper.

DETAILED DESCRIPTION OF THE INVENTION

It has surprisingly been found that the negative impact on pulp and paper making processes by the presence of disturbing and detrimental substances in aqueous cellulosic pulp suspensions, specifically problems caused by pitch and stickies, can be reduced by treating cellulosic fibres with a clay according to the invention.

It has surprisingly also been found that the addition to cellulosic suspensions of a clay according to the invention, specifically a cationic and/or $3R_2$ clay, in conjunction with additives used for pulp and paper making not only allows for adsorption and removal of disturbing substances, but it also improves the performance of the additives used in the process, as compared to the situation when the clay is not added. Examples of such additives for which improved performance is observed include retention and dewatering aids, sizing agents, etc. preferably, the clay is used together with one or more drainage and retention aids comprising at least one cationic polymer. Thus, the present invention provides improved drainage (dewatering) and retention in pulp and paper making processes as well as improved sizing in paper making processes, while simultaneously further reducing the content of disturbing and detrimental substances in the cellulosic suspension.

The clay according to the invention can be derived from naturally occurring clays, chemically and/or physically modified naturally occurring clays, and synthetic clays. Naturally occurring clays normally have an essentially crystalline structure. However, synthetically obtained clays may also additionally contain amorphous material having essentially the same chemical composition as the crystalline structures. The amount of amorphous material present in synthetic clay depends mainly on the reaction parameters used. The term "clay", as used herein, refers to clays having essentially crystalline structure and also to clays containing both crystalline and amorphous structures.

Clays are characterised by a layered structure wherein atoms within the layers (lamellae) are cross-linked by chemical bonds, while the atoms of adjacent layers interact mainly by physical forces. The layers of the clay may be non-charged or charged depending on the type of atoms present in the layers. If the layers are charged, then the space between these layers, also designated as the interlayer space, contains ions which have the opposite charge with respect to the charge of the layers. The term "cationic clay", as used herein, refers to clays having positively charged layers and anions present in the interlayer space. The term "anionic clay", as used herein, refers to clays having negatively charged layers and cations present in the interlayer space. Usually the ions in the interlayer space are exchangeable.

The clays according to the invention can virtually have any anion, optionally also water molecules, present in the interlayer space. Examples of common anions that can be present in the interlayer space include $NO_3^-$, $OH^-$, $Cl^-$, $Br^-$, $I^-$, $CO_3^{2-}$; $SO_4^{2-}$, $SiO_3^{2-}$, $CrO_4^{2-}$, $BO_3^{2-}$, $MnO_4^-$, $HGaO_3^{2-}$, $HVO_4^-$, and $ClO_4^-$; as well as pillaring or intercalating anions such as $V_{10}O_{28}^{6-}$ and $MO_7O_{24}^{6-}$, monocarboxylates like acetate, dicarboxylates such as oxalate, and alkyl sulphonates such as lauryl sulphonate; usually hydroxide and carbonate. Naturally occurring clays of the invention commonly have carbonate anions in the interlayer space.

The layer or lamella of the clay suitably comprises at least two different metal atoms having different valences. Suitably, one metal atom is divalent and the other metal atom is suitably trivalent. However, the layer may also comprise more than two metal atoms. The charge of the layer is governed by the ratio of metal atoms having different valences. For instance, a higher amount of trivalent metals will render a layer having an increased density of the positive charge. Suitably, the clay of the invention comprises layers containing divalent and trivalent metals in a ratio so that the overall charge of the layers is cationic, and the interlayers comprise anions. Preferably, the layers essentially consist of divalent and trivalent metals in such a ratio that the overall charge of the layers is cationic.

Synthetically produced and naturally occurring clays according to the invention can be characterised by the general formula:

$$[M_m^{2+}M_n^{3+}(OH)_{2m+2n}]X_{n/z}^{Z-}.bH_2O,$$

wherein m and n, independently of each other, are integers having a value such that m/n is in the range of from 1 to 10, preferably 1 to 6, more preferably 2 to 4 and most preferably values around 3; b is an integer having a value in the range of from 0 to 10, suitably a value from 2 to 6, and often a value about 4; $X_{n/z}^{Z-}$ is an anion where z is an integer from 1 to 10, preferably from 1 to 6, suitable $X_{n/z}^{Z-}$ including $NO_3^-$, $OH^-$, $Cl^-$, $Br^-$, $I^-$, $CO_3^{2-}$, $SO_4^{2-}$, $SiO_3^{2-}$, $CrO_4^{2-}$, $BO_3^{2-}$, $MnO_4^-$, $HGaO_3^{2-}$, $HVO_4^-$, $ClO_4^-$, pillaring and intercalating anions such as $V_{10}O_{28}^{6-}$ and $MO_7O_{24}^{6-}$, mono-carboxylates like acetate, dicarboxylates such as oxalate, and alkyl sulphonates such as lauryl sulphonate; $M^{2+}$ is a divalent metal atom, suitable divalent metal atoms including Be, Mg, Cu, Ni, Co, Zn, Fe, Mn, Cd, and Ca, preferably Mg; $M^{3+}$ is a trivalent metal atom, suitable trivalent metal atoms including Al, Ga, Ni, Co, Fe, Mn, Cr, V, Ti and In, preferably Al. Preferably, the divalent metal is magnesium and the trivalent metal is aluminium, rendering the general formula:

$$[Mg_m^{2+}Al_n^{3+}(OH)_{2m+2n}]X_{n/z}^{Z-}.bH_2O.$$

According to one preferred embodiment of the invention, the clay is cationic. Examples of suitable cationic clays according to the invention include hydrotalcite, manasseite, pyroaurite, sjögrenite, stichtite, barbertonite, takovite, reevesite, desautelsite, motukoreaite, wermlandite, meixnerite, coalingite, chloromagalumite, carrboydite, honessite, woodwardite, iowaite, hydrohonessite, mountkeithite, etc. Examples of terms also used to describe these clays include hydrotalcite-like compounds and layered double hydroxide compounds.

According to another preferred embodiment of the invention, the clay has a specific stacking, namely a $3R_2$ stacking; this type of clay is herein also referred to as "$3R_2$ clay". The $3R_2$ clay is preferably cationic, and the clay can be any of those mentioned above. Preferably, the clay is magnesium-aluminium-containing $3R_2$ clay. The $3R_2$ clay suitably has a three-layer repeat. The $3R_2$ stacking polytype of clay has a different layer arrangement/stacking than the $3R_1$ stacking polytype, herein also referred to as "$3R_1$ clay". The $3R_1$ and $3R_2$ clays can be distinguished from each other by X-ray diffraction/reflections patterns by the intensities of the 107 and 108 $d_{hkl}$ reflections. The $3R_2$ clay has a stronger $d_{hkl}$ 107 reflection close to 45° 2 theta (according to Drits and Bookin), whereas the $3R_1$ clay has a stronger $d_{hkl}$ reflection close to 47° 2 theta (the $d_{hkl}$ 108 reflection). The presence of peaks at both 45° 2 theta and 47° 2 theta indicates the presence of a mixture of $3R_1$ and $3R_2$ clays. It is understood that the precise 2 theta values for the 107 and 108 $d_{hkl}$ reflections will depend on the lattice "a" and "c" structural parameters for the clay, for example Mg—Al clay. Of course, there are some other differences in the X-ray diffraction patterns as well, but it is believed that this is the best range of the $d_{hkl}$ reflections to make such a distinction. Furthermore, the clay having $3R_2$ stacking has a different morphology compared to that of conventional $3R_1$ clays, as can be detected by the SEM examinations. The $3R_2$ clay appears to have a structure with irregular flake-like platelets which are randomly agglomerated, whereas the conventional and prior art $3R_1$ clays have regular well-formed layers of platelets which are arranged in the usual book-stack form.

Clays having $3R_2$ stacking according to the invention can be prepared by hydrothermal treatment (solvo thermal) of a slurry containing an aluminium source and a magnesium source. Examples of suitable clays having $3R_2$ stacking, e.g. Mg—Al clays, according to the invention and methods for their preparation include those disclosed in International Patent Application Publication No. WO 01/12550, the disclosure of which is hereby incorporated herein by reference.

According to one preferred embodiment of the invention, the clay having $3R_2$ stacking is added to an aqueous suspension containing cellulosic fibres in a process for the production of a cellulosic product like pulp and paper. It has been observed that if the $3R_2$ clay is added to such a suspension, improved removal of disturbing substances such as pitch and stickies is achieved over the addition of conventional clay having $3R_1$ stacking.

The clay is suitably mixed with cellulosic fibres by being added to an aqueous suspension containing cellulosic fibres (herein also referred to as "aqueous cellulosic suspension" and "cellulosic suspension") either as a slurry (suspension) or powder, which can be easily dispersed in water. The suspension or powder of clay may further also contain other components such as, for example, dispersing and/or protecting agents, which can contribute to the overall effect of the clay. Such agents can have non-ionic, anionic or cationic character. Examples of suitable protective agents or colloids include water-soluble cellulose derivatives, e.g. hydroxyethyl- and hydroxypropyl-, methylhydroxypropyl- and ethyl-hydroxyethyl-cellulose, methyl- and carboxymethylcellulose, gelatine, starch, guar gum, xanthan gum, polyvinyl alcohol, etc. Examples of suitable dispersing agents include non-ionic agents, e.g. ethoxytated fatty acids, fatty acids, alkyl phenols or fatty acid amides, ethoxylated and non-ethoxylated glycerol esters, sorbitan esters of fatty acids, non-ionic surfactants, polyols and/or their derivatives; anionic agents, e.g. as alkyl or alkylaryl sulphates, sulphonates, ethersulphonates, polyacrylic acid; and cationic agent, e.g. esterquats obtained by reacting alkanolamines with mixtures of fatty acids and dicarboxylic acids, optionally alkoxylating the resulting esters and quaternising the products, quaternised fatty acid amides, betaines, dimethyl dialkyl or dialkylaryl ammonium salts, and cationic gemini dispersing agents.

The clay can be added at any point in the cellulosic product production process starting from the point where wood chips are disintegrated up to the point in the process where dewatering of the cellulosic suspension takes place. The cellulosic product can be in any form such as, for example, in the form of a web or sheet, e.g. pulp sheets and paper sheets.

According to a preferred embodiment of the invention, the clay is added to a cellulosic suspension of a pulp making process. The clay can be added prior to or after the pulping process which can be kraft, mechanical, thermo-mechanical, chemomechanical, chemo-thermo-mechanical pulping processes. The clay can be added just before the pulping process or directly to the pulping process, such as to the digester. However, it is preferred that the clay is added to the cellulosic suspension subsequent to chemical digestion such as after the brown stock washer, or after refining of (chemo-) mechanical pulp. Usually, the cellulosic pulp is bleached in a multi stage bleaching process comprising different bleaching stages and the clay can be added to any bleaching sequence. Examples of suitable bleaching stages include chlorine bleaching stages, e.g. elementary chlorine and chlorine dioxide bleaching stages, non-chlorine bleaching stages, e.g. peroxide stages like ozone, hydrogen peroxide and peracetic acid, and combinations of chlorine and non-chlorine bleaching and oxidizing stages, optionally in combination with reducing stages like treatment with dithionite. The day can be added to the cellulosic suspension directly to a bleaching stage, preferably to the mixer prior to the bleaching tower, at any point between the bleaching and washing stages, and also to a washing stage where the clay may be partly or wholly removed, e.g. in the displacement section.

According to another preferred embodiment of the invention, the clay is added to a cellulosic suspension of a paper making process. The clay can be added to the cellulosic suspension at any point of the paper making process such as to the thick stock, thin stock, or to the white water before it is recycled, e.g. prior to the thin stock feed box. Preferably, the clay is added to the thick stock. The cationic clay can also be added to more than one point of the pulp and/or paper making processes. For instance, in integrated pulp and paper mills, the clay can be added in the process for pulp production, and optionally also in the process for paper production, and one or more drainage and retention aids can be added in the process for paper production. Such processes can include dewatering the cellulosic suspension containing clay, diluting the suspension obtained, adding to the diluted suspension one or more drainage and retention aids and dewatering the suspension containing the drainage and retention aids.

The term "paper", as used herein, include not only paper and the production thereof, but also other cellulosic fibre-containing sheet or web-like products, such as for example board and paperboard, and the production thereof. The process can be used in the production of paper from different types of aqueous suspensions of cellulosic (cellulose-containing) fibres and the suspensions should suitably contain at least 25% by weight and preferably at least 50% by weight of such fibres, based on a dry substance. The cellulosic fibres can be based on virgin and/or recycled fibres, and the suspension can be based on fibres from chemical pulp such as sulphate, sulphite and organosolve pulps, mechanical pulp such as thermo-mechanical pulp, chemo-thermo-mechanical pulp, refiner pulp and ground wood pulp, from both hardwood and softwood, and can also be based on recycled fibres, optionally from de-inked pulps, and mixtures thereof. If recycled fibres are used the suspended, recycled fibres are commonly treated in order to separate the non-fibre components such as, for example, printing inks and various paper surface treatment compounds, e.g. latex from the fibres. In a preferred embodiment, the clay is suitably added to such a de-inking treatment process.

According to the invention, the clay is suitably added to the cellulosic suspension in an amount of from about 0.01% by weight to about 5% by weight, preferably form about 0.05% by weight up to about 2% by weight, calculated as dry clay on a dry cellulosic suspension.

The present invention also relates to a process for the production of a cellulosic product, e.g. pulp and paper, which comprises adding to the suspension a clay having $3R_2$ stacking and optionally one or more drainage (dewatering) and retention aids. In a preferred embodiment, the drainage and retention aids comprise at least one cationic polymer. It is preferred that the clay and drainage and retention aids are used in a process for the production of paper. The term "drainage and retention aid", as used herein, refers to a component (agent, additive) which, when being added to an aqueous cellulosic suspension, give better drainage and/or retention than is obtained when not adding said component. The term "cationic polymer", as used herein, refers to an organic polymer having one or more cationic groups, preferably an overall cationic charge. The cationic polymer may also contain anionic groups, and such polymers are commonly also referred to as amphoteric polymers.

The cationic polymer according to the invention can be derived from natural and synthetic sources. Examples of suitable cationic polymers derived from natural sources include polysaccharides, e.g. starches, guar gums, celluloses, chitins, chitosans, glycans, galactans, glucans, xanthan gums, pectins, mannans, dextrins, preferably starches and guar gums. Examples of suitable starches include potato, corn, wheat, tapioca, rice, waxy maize, barley, etc. Examples of suitable synthetic, cationic polymers include chain-growth polymers, e.g. vinyl addition polymers like acrylate-, acrylamide- and vinylamide-based polymers, and step-growth polymers, e.g. polyurethanes. Suitably, the cationic polymer is selected from polysaccharides, e.g. starches, and vinyl addition polymers, e.g. acrylamide-based polymers, and mixtures thereof.

The cationic polymer, specifically cationic polysaccharides and vinyl addition polymers, may also comprise aromatic groups which can be present in the polymer backbone or, preferably, the aromatic groups can be a pendent group attached to or extending from the polymer backbone or be present in a pendent group that is attached to or extending from the polymer backbone (main-chain). Examples of suitable aromatic groups include aryl, aralkyl and alkaryl groups, e.g. phenyl, phenylene, naphthyl, phenylene, xylylene, benzyl and phenylethyl; nitrogen-containing aromatic (aryl) groups, e.g. pyridinium and quinolinium, as well as derivatives of these groups, preferably benzyl. Examples of cationically charged groups that can be present in the cationic polymer as well as in monomers used for preparing the cationic polymer include quaternary ammonium groups, tertiary amino groups and acid addition salts thereof.

The cationic organic polymer having an aromatic group is preferably a polysaccharide represented by the general structural formula (I):

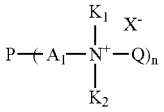

(I)

wherein P is a residue of a polysaccharide; $A_1$ is a group attaching N to the polysaccharide residue, suitably a chain of atoms comprising C and H atoms, and optionally O and/or N atoms, usually an alkylene group with from 2 to 18 and suitably 2 to 8 carbon atoms, optionally interrupted or substituted by one or more heteroatoms, e.g. O or N, e.g. an alkyleneoxy group or hydroxy propylene group (—$CH_2$—CH(OH)—$CH_2$—); $K_1$ and $K_2$ are each H or, preferably, a hydrocarbon group, suitably alkyl, having from 1 to 3 carbon atoms, preferably 1 to 2 carbon atoms; Q is a substituent containing an aromatic group, suitably a phenyl or substituted phenyl group, which can be attached to the nitrogen by means of an alkylene group usually having from 1 to 3 carbon atoms, suitably 1 to 2 carbon atoms, and preferably Q is a benzyl group (—$CH_2$—$C_6H_5$); n is an integer, usually from about 2 to about 300,000, suitably from 5 to 200,000 and preferably from 6 to 125,000 or, alternatively, $K_1$, $K_2$ and Q together with N form a aromatic group containing from 5 to 12 carbon atoms; and $X^-$ is an anionic counterion, usually a halide like chloride. Suitable polysaccharides of the general formula (I) include those mentioned above. Cationic polysaccharides according to the invention can also contain anionic groups, preferably in a minor amount. Such anionic groups may be introduced in the polysaccharide by means of chemical treatment or be present in the native polysaccharide.

The cationic organic polymer having an aromatic group may also be a chain-growth polymer. The term "chain-growth polymer", as used herein, refers to a polymer obtained by chain-growth polymerisation, also being referred to as chain reaction polymer and chain reaction polymerisation, respectively. Examples of suitable chain-growth polymers include vinyl addition polymers prepared by polymerisation of one or more monomers having a vinyl group or ethylenically unsaturated bond, for example a polymer obtained by polymerising a cationic monomer or a monomer mixture comprising a cationic monomer represented by the general structural formula (II):

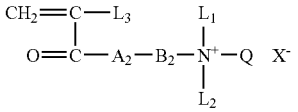

(II)

wherein $L_3$ is H or $CH_3$; $L_1$ and $L_2$ are each H or, preferably, a hydrocarbon group, suitably alkyl, having from 1 to 3 carbon atoms, preferably 1 to 2 carbon atoms; $A_2$ is O or NH; $B_2$ is an alkyl or alkylene group having from 2 to 8 carbon atoms, suitably from 2 to 4 carbon atoms, or a hydroxy propylene group; Q is a substituent containing an aromatic group, suitably a phenyl or substituted phenyl group, which can be attached to the nitrogen by means of an alkylene group usually having from 1 to 3 carbon atoms, suitably 1 to 2 carbon atoms, and preferably Q is a benzyl group (—$CH_2$—$C_6H_5$); and $X^-$ is an anionic counterion, usually a halide like chloride.

Examples of suitable monomers represented by the general formula (II) include quaternary monomers obtained by treating dialkylaminoalkyl (meth)acrylates, e.g. dimethylaminoethyl (meth)acrylate, diethylaminoethyl (meth)acrylate and dimethylaminohydroxypropyl (meth)acrylate, and dialkylaminoalkyl (meth)acrylamides, e.g. dimethylaminoethyl (meth)acrylamide, diethylaminoethyl (meth)acrylamide, dimethylaminopropyl (meth)acrylamide, and diethylaminopropyl (meth)acrylamide, with benzyl chloride. Preferred cationic monomers of the general formula (I) include dimethylaminoethylacrylate benzyl chloride quaternary salt and dimethylaminoethylmethacrylate benzyl chloride quaternary salt. The monomer of formula (II) can be copolymerized with one or more non-ionic, cationic and/or anionic monomers. Suitable copolymerizable non-ionic monomers include (meth)acrylamide; acrylamide-based monomers like N-alkyl (meth)acrylamides, N,N-dialkyl (meth)acrylamides and dialkylaminoalkyl (meth)acrylamides, acrylate-based monomers like dialkylaminoalkyl (meth)acrylates, and vinylamides. Suitable copolymerizable cationic monomers include acid addition salts and quaternary salts of dimethylaminoethyl (meth)acrylate and diallyldimethylammonium chloride. The cationic organic polymer may also contain anionic groups, preferably in a minor amount. Suitable copolymerizable anionic monomers include acrylic acid, methacrylic acid and various sulphonated vinylic monomers such as styrenesulphonate. Preferred copolymerizable monomers include acrylamide and methacrylamide, i.e. (meth)acrylamide, and the cationic or amphoteric organic polymer is preferably an acrylamide-based polymer.

Cationic aromatic vinyl addition polymers according to this invention can be prepared from a monomer mixture generally comprising from 1 to 99 mole %, suitably from 2 to 50 mole % and preferably from 5 to 20 mole % of cationic monomer having an aromatic group and from 99 to 1 mole %, suitably from 98 to 50 mole %, and preferably from 95 to 80 mole % of other copolymerizable monomers which preferably comprises acrylamide or methacrylamide ((meth) acrylamide), the monomer mixture suitably comprising from 98 to 50 mole % and preferably from 95 to 80 mole % of (meth)acrylamide, the sum of percentages being 100.

Examples of suitable aromatic cationic step-growth polymers according to the invention include cationic polyurethanes, which can be prepared from a monomer mixture comprising aromatic isocyanates and/or aromatic alcohols. Examples of suitable aromatic isocyanates include diisocyanates, e.g. toluene-2,4- and 2,6-diisocyanates and diphenylmethane-4,4'-diisocyanate. Examples of suitable aromatic alcohols include dihydric alcohols, i.e. diols, e.g. bisphenol A, phenyl diethanol amine, glycerol monoterephthalate and trimethylolpropane monoterephthalate. Monohydric aromatic alcohols such as phenol and derivatives thereof may also be employed. The monomer mixture can also contain non-aromatic isocyanates and/or alcohols, usually diisocyanates and diols, for example any of those known to be useful in the preparation of polyurethanes. Examples of suitable monomers containing cationic groups include cationic diols such as acid addition salts and quaternisation products of N-alkandiol dialkylamines and N-alkyl dialkanolamines like 1,2-propanediol-3-dimethylamine, N-methyl diethanolamine, N-ethyl diethanolamine, N-propyl diethanolamine, N-n-butyl diethanolamine and N-t-butyl diethanolamine, N-stearyl diethanolamine and N-methyl dipropanolamine. The quaternization products can be derived from alkylating agents like methyl chloride, dimethyl sulphate, benzyl chloride and epichlorohydrin.

Examples of suitable cationic organic polymers having an aromatic group that can be used according to the present invention include those described in International Patent Application Publication Nos. WO 99/55964, WO 99/55965, WO 99/67310 and WO 02/12626, which are hereby incorporated herein by reference.

The weight average molecular weight of the cationic polymer can vary within wide limits dependent on, inter alia, the type of polymer used, and usually ft is at least about 5,000 and often at least 10,000. More often, it is above 150,000, normally above 500,000, suitably above about 700,000, preferably above about 1,000,000 and most preferably above about 2,000,000. The upper limit is not critical; it can be about 200,000,000, usually 150,000,000 and suitably 100,000,000.

The cationic organic polymer, such as polysaccharides and vinyl addition polymers, can have a degree of cationic substitution ($DS_C$) varying over a wide range dependent on, inter alia, the type of polymer used; $DS_C$ can be from 0.005 to 1.0, usually from 0.01 to 0.5, suitably from 0.02 to 0.3, preferably from 0.025 to 0.2; and the degree of aromatic substitution ($DS_Q$) can be from 0.001 to 0.5, usually from 0.01 to 0.5, suitably from 0.02 to 0.3 and preferably from 0.025 to 0.2. In case the cationic organic polymer contains anionic groups, the degree of anionic substitution ($DS_A$) can be from 0 to 0.2, suitably from 0 to 0.1 and preferably from 0 to 0.05, the cationic polymer having an overall cationic charge. Usually the charge density of the cationic polymer is within the range of from 0.1 to 6.0 meqv/g of dry polymer, suitably from 0.2 to 5.0 and preferably from 0.5 to 4.0.

According to a preferred embodiment of the invention, the drainage and retention aid comprises, in addition to the cationic polymer, also an anionic material. Examples of suitable anionic materials include anionic microparticulate materials, e.g. anionic inorganic and organic particles, and anionic organic polymers, e.g. anionic vinyl addition polymers such as anionic acrylamide-based polymers.

Anionic inorganic microparticulate materials that can be used include anionic silica-based particles and anionic clays of the smectite type. It is preferred that the anionic inorganic particles are in the colloidal range of particle size. Anionic silica-based particles, i.e. particles based on $SiO_2$ or silicic add, are preferably used and such particles are usually supplied in the form of aqueous colloidal dispersions, so-called sols. Examples of suitable silica-based particles include colloidal silica and different types of polysilicic acid, either homo- or co-polymerised. The silica-based sols can be modified and contain other elements, e.g. aluminium, boron, nitrogen, zirconium, gallium, titatnium and the like, which can be present in the aqueous phase and/or in the silica-based particles. Suitable silica-based particles of this type include colloidal aluminium-modified silica and aluminium silicates. Mixtures of such suitable silica-based particles can also be used. Drainage and retention aids comprising suitable anionic silica-based particles include those disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,573,674; 5,584,966; 5,603,805; 5,688,482; and 5,707,493; which are hereby incorporated herein by reference.

Anionic silica-based particles suitably have an average particle size below about 100 nm, preferably below about 20 nm and more preferably in the range of from about 1 to about 10 nm. As conventional in the silica chemistry, the particle size refers to the average size of the primary particles, which may be aggregated or non-aggregated. The specific surface area of the silica-based particles is suitably above 50 $m^2/g$ and preferably above 100 $m^2/g$. Generally, the specific surface area can be up to about 1700 $m^2/g$ and preferably up to 1000 $m^2/g$. The specific surface area is measured by means of titration with NaOH in a well known manner, e.g. as described by G. W. Sears in Analytical Chemistry 28(1956): 12, 1981-1983 and in the U.S. Pat. No. 5,176,891. The given area thus represents the average specific surface area of the particles.

According to a preferred embodiment of the invention, the anionic silica-based particles have specific surface area within the range of from 50 to 1000 $m^2/g$, preferably from 100 to 950 $m^2/g$. Sols of silica-based particles of these types also encompass modifications, for example with any of the elements mentioned above. Preferably, the silica-based particles are present in a sol having an value in the range of from 8 to 50%, preferably from 10 to 40%, containing silica-based particles with a specific surface area in the range of from 300 to 1000 $m^2/g$, suitably from 500 to 950 $m^2/g$, and preferably from 750 to 950 $m^2/g$, which sols can be modified as mentioned above. The S-value can be measured and calculated as described by Iler & Dalton in J. Phys. Chem. 60(1956), 955-957. The S-value indicates the degree of aggregation or microgel formation and a lower S-value is indicative of a higher degree of aggregation.

According to another preferred embodiment of the invention, the silica-based particles are selected from polysilicic acid, either homo- or co-polymerised, having a high specific surface area, suitably above about 1000 $m^2/g$. The specific surface area can be within the range of from 1000 to 1700 $m^2/g$ and preferably from 1050 to 1600 $m^2/g$. The sols of modified or co-polymerised polysilicic acid can contain other elements as mentioned above. In the art, polysilicic acid is also referred to as polymeric silicic acid, polysilicic acid microgel, polysilicate and polysilicate microgel, which all are encompassed by the term polysilicic acid used herein. Aluminium-containing compounds of this type are commonly also referred to as polyaluminosilicate and polyaluminosilicate microgel, which are both, encompassed by the terms colloidal aluminium-modified silica and aluminium silicate used herein.

According to yet another preferred embodiment of the invention, the drainage and retention aid comprise anionic clay of the smectite type. Examples of suitable smectite clays include natural clays such as montmorillonite/bentonite, hectorite, beidelite, nontronite and saponite, as well as synthetic smectite-like clays such as laponite, etc., preferably bentonite and especially such bentonite which after swelling preferably has a surface area of from 200 to 800 $m^2/g$. Suitable anionic clays include those disclosed in U.S. Pat. Nos. 4,753,710; 5,071,512; and 5,607,552, which are hereby incorporated herein by reference. Also mixtures of anionic silica-based particles and anionic clays of the smectite type can be employed.

Anionic organic polymers according to the invention contain one or more negatively charged (anionic) groups. Examples of groups that can be present in the polymer as well as in the monomers used for preparing the polymer include groups carrying an anionic charge and acid groups carrying an anionic charge when dissolved or dispersed in water, the groups herein collectively being referred to as anionic groups, such as phosphate, phosphonate, sulphate, sulphonic acid, sulphonate, carboxylic acid, carboxylate, alkoxide and phenolic groups, i.e. hydroxy-substituted phenyls and naphthyls. Groups carrying an anionic charge are usually salts of an alkali metal, alkaline earth or ammonia.

Anionic organic particles that can be used according to the invention include cross-linked anionic vinyl addition polymers, suitably copolymers comprising an anionic monomer like acrylic acid, methacrylic acid and sulfonated or phosphonated vinyl addition monomers, usually copolymerised with non-ionic monomers like (meth)acrylamide, alkyl (meth)acrylates, etc. Useful anionic organic particles also include anionic condensation polymers, e.g. melamine-sulfonic acid sols.

Further anionic polymers that can form part of the drainage and retention system include vinyl addition polymers comprising an anionic monomer having carboxylate groups like acrylic acid, methacrylic acid ethylacrylic acid, crotonic acid, itaconic acid, maleic acid and salts of any of the foregoing, anhydrides of the diacids, and sulfonated vinyl addition monomers, such as sulfonated styrene, usually copolymerised with non-ionic monomers like acrylamide, alkyl acrylates, etc., for example those disclosed in U.S. Pat. Nos. 5,098,520 and 5,185,062, the teachings of which are hereby incorporated herein by reference. The anionic vinyl addition polymers suitably have weight average molecular weights from about 50,000 to about 5,000,000, typically from about 75,000 to about 1,250,000.

Examples of suitable anionic organic polymer further include step-growth polymers, chain-growth polymers, polysaccharides, naturally occurring aromatic polymers and modifications thereof. The term "step-growth polymer", as used herein, refers to a polymer obtained by step-growth polymerisation, also being referred to as step-reaction polymer and step-reaction polymerisation, respectively. The anionic organic polymers can be linear, branched or cross-linked. Preferably the anionic polymer is water-soluble or water-dispersable. In a preferred embodiment, the anionic organic polymer also contains one or more aromatic groups.

Anionic organic polymers having aromatic groups contain one or more aromatic groups of the same or different types. The aromatic group of the anionic polymer can be present in the polymer backbone or in a substituent group that is attached to the polymer backbone (main chain). Examples of suitable aromatic groups include aryl, aralkyl and alkaryl groups and derivatives thereof, e.g. phenyl, tolyl, naphthyl, phenylene, xylylene, benzyl, phenylethyl and derivatives of these groups.

Examples of suitable anionic aromatic step-growth polymers include condensation polymers, i.e. polymers obtained by step-growth condensation polymerisation, e.g. condensates of an aldehyde such as formaldehyde with one or more aromatic compounds containing one or more anionic groups, and optional other co-monomers useful in the condensation polymerisation such as urea and melamine. Examples of suitable aromatic compounds containing anionic groups comprises benzene and naphthalene-based compounds containing anionic groups such as phenolic and naphtholic compounds, e.g. phenol, naphthol, resorcinol and derivatives thereof, aromatic acids and salts thereof, e.g. phenylic, phenolic, naphthylic and naphtholic adds and salts, usually sulphonic acids and sulphonates, e.g. benzene sulphonic acid and sulphonate, xylen sulphonic acid and sulphonates, naphthalene sulphonic acid and sulphonate, phenol sulphonic acid and sulphonate. Examples of suitable anionic step-growth polymers according to the invention include anionic benzene-based and naphthalene-based condensation polymers, preferably naphthalene-sulphonic acid based and naphthalene-sulphonate based condensation polymers.

Examples of further suitable anionic step-growth polymers having aromatic groups include addition polymers, i.e. polymers obtained by step-growth addition polymerisation, e.g. anionic polyurethanes, which can be prepared from a monomer mixture comprising aromatic isocyanates and/or aromatic alcohols. Examples of suitable aromatic isocyanates include diisocyanates, e.g. toluene-2,4- and 2,6-diisocyanates and diphenylmethane-4,4'-diisocyanate. Examples of suitable aromatic alcohols include dihydric alcohols, i.e. diols, e.g. bisphenol A, phenyl diethanol amine, glycerol monoterephthalate and trimethylolpropane monoterephthalate. Monohydric aromatic alcohols such as phenol and derivatives thereof may also be employed. The monomer mixture can also contain non-aromatic isocyanates and/or alcohols, usually diisocyanates and diols, for example any of those known to be useful in the preparation of polyurethanes. Examples of suitable monomers containing anionic groups include the monoester reaction products of triols, e.g. trimethylolethane, trimethylolpropane and glycerol, with dicarboxylic acids or anhydrides thereof, e.g. succinic acid and anhydride, terephthalic acid and anhydride, such as glycerol monosuccinate, glycerol monoterephthalate, trimethylolpropane monosuccinate, trimethylolpropane monoterephthalate, N,N-bis-(hydroxyethyl)-glycine, di-(hydroxymethyl)propionic acid, N,N-bis-(hydroxyethyl)-2-aminoethanesulphonic acid, and the like, optionally and usually in combination with reaction with a base, such as alkali metal and alkaline earth hydroxides, e.g. sodium hydroxide, ammonia or an amine, e.g. triethylamine, thereby forming an alkali metal, alkaline earth or ammonium counter-ion.

Examples of suitable anionic chain-growth polymers having aromatic groups include anionic vinyl addition polymers obtained from a mixture of vinylic or ethylenically unsaturated monomers comprising at least one monomer having an aromatic group and at least one monomer having an anionic group, usually co-polymerised with non-ionic monomers such as acrylate- and acrylamide-based monomers. Examples of suitable anionic monomers include (meth)acrylic acid and paravinyl phenol (hydroxy styrene).

Examples of suitable anionic polysaccharides having aromatic groups include starches, guar gums, celluloses, chitins, chitosans, glycans, galactans, glucans, xanthan gums, pectins, mannans, dextrins, preferably starches, guar gums and cellulose derivatives, suitable starches including potato, corn, wheat, tapioca, rice, waxy maize and barley, preferably potato. The anionic groups in the polysaccharide can be native and/or introduced by chemical treatment. The aromatic groups in the polysaccharide can be introduced by chemical methods known in the art.

Naturally occurring aromatic anionic polymers and modifications thereof, i.e. modified naturally occurring aromatic anionic polymers, according to the invention include naturally occurring polyphenolic substances that are present in wood and organic extracts of bark of some wood species and chemical modifications thereof, usually sulphonated modifications thereof. The modified polymers can be obtained by chemical processes such as, for example, sulphite pulping and kraft pulping. Examples of suitable anionic polymers of this type include lignin-based polymers, preferably sulphonated lignins, e.g. lignosulphonates, kraft lignin, sulphonated kraft lignin, and tannin extracts.

The weight average molecular weight of the anionic polymer having aromatic groups can vary within wide limits dependent on, inter alia, the type of polymer used, and usually it is at least about 500, suitably above about 2,000 and preferably above about 5,000. The upper limit is not critical; it can be about 200,000,000, usually about 150,000,000, suitably about 100,000,000 and preferably about 10,000,000.

The anionic polymer having aromatic groups can have a degree of anionic substitution ($DS_A$) varying over a wide range dependent on, inter alia, the type of polymer used; $DS_A$ is usually from 0.01 to 2.0, suitably from 0.02 to 1.8 and preferably from 0.025 to 1.5; and the degree of aromatic substitution ($DS_Q$) can be from 0.001 to 1.0, usually from 0.01 to 0.8, suitably from 0.02 to 0.7 and preferably from 0.025 to 0.5. In case the anionic polymer contains cationic groups, the degree of cationic substitution ($DS_C$) can be, for example, from 0 to 0.2, suitably from 0 to 0.1 and preferably from 0 to 0.05, the anionic polymer having an overall anionic charge. Usually the anionic charge density of the anionic polymer is within the range of from 0.1 to 6.0 meqv/g of dry polymer, suitably from 0.5 to 5.0 and preferably from 1.0 to 4.0.

Examples of suitable aromatic, anionic organic polymers that can be used according to the present invention include those described in U.S. Pat. Nos. 4,070,236 and 5,755,930; and International Patent Application Publication Nos. WO 95/21295, WO 95/21296, WO 99/67310, WO 00/49227 and WO 02/12626, which are hereby incorporated herein by reference.

Further to the above mentioned cationic and anionic drainage and retention aids, low molecular weight cationic organic polymers and/or inorganic aluminium compounds can also be used as drainage and retention aids.

Low molecular weight (hereinafter called LMW) cationic organic polymers that can be used in conjunction with the dewatering and retention aid include those commonly referred to and used as anionic trash catchers (ATC). ATC's are known in the art as neutralising and/or fixing agents for disturbing/detrimental anionic substances present in the stock and the use thereof in combination with drainage and retention aids often provide further improved drainage and/or retention. The LMW cationic organic polymer can be derived from natural or synthetic sources, and preferably it is a LMW synthetic polymer. Suitable organic polymers of this type include LMW highly charged cationic organic polymers such as polyamines, polyamidoamines, polyethyleneimines, homo- and copolymers based on diallyldimethyl ammonium chloride, (meth)acrylamides and (meth) acrylates, vinylamide-based and polysaccarides. In relation to the molecular weight of the retention and dewatering polymers, the weight average molecular weight of the LMW cationic organic polymer is preferably lower; it is suitably at least about 2,000 and preferably at least about 10,000. The upper limit of the molecular weight is usually about 2,000,000, to about 3,000,000. Suitable LMW polymers may have a weight average molecular weight of from about 2,000 up to about 2,000,000.

Aluminium compounds that can be used as ATC's, according to the invention include alum, aluminates, aluminium chloride, aluminium nitrate and polyaluminium compounds, such as polyaluminium chlorides, polyaluminium sulphates, polyaluminium compounds containing both chloride and sulphate ions, polyaluminium silicate-sulphates, and mixtures thereof. The polyaluminium compounds may also contain other anions than chloride ions, for example anions from sulfuric acid, phosphoric acid, and organic acids such as citric acid and oxalic acid.

According to one preferred embodiment of the invention, the drainage and retention aid comprises a cationic polymer and an anionic inorganic microparticulate material, suitably anionic silica-based particles or anionic clay of the smectite type. According to another preferred embodiment of the invention, the drainage and retention aid comprises a cationic polymer and an anionic vinyl addition polymer, suitably an anionic acrylamide-based polymer. According to yet another preferred embodiment of the invention, the drainage and retention aid comprises a cationic polymer comprising aromatic groups. According to yet another preferred embodiment of the invention, the drainage and retention aid comprises a cationic polymer comprising aromatic groups and an anionic polymer comprising aromatic groups.

The components of drainage and retention aids can be added to the cellulosic suspension in conventional manner and in any order. When using an anionic microparticulate material, it is preferred to add the cationic polymer to the suspension before adding the microparticulate material, even if the opposite order of addition may be used. It is further preferred to add the cationic polymer before a shear stage, which can be selected from pumping, mixing, cleaning, etc., and to add the anionic compound after that shear stage. When using an LMW cationic organic polymer and/or an aluminium compound, such components are preferably introduced into the suspension prior to introducing the catonic polymer and anionic component, if used. Alternatively, the LMW catonic organic polymer and cationic polymer can be introduced into the suspension essentially simultaneously, either separately or in admixture, e.g. as disclosed in U.S. Pat. No. 5,858,174, which is hereby incorporated herein by reference.

If the clay according to the invention is used together with a drainage and retention aid, the clay can be added to the suspension prior to or after the addition of the drainage and retention aid. However, it is preferred that the catonic clay is added prior to the addition of drainage and retention aid and other performance chemicals. Suitably, the clay is added to the thick stock, or to the thin stock, and the drainage and retention aid is added to the thin stock. The clay can also be added to the recycled white water. If two or more drainage and retention aids are used, i.e. a cationic polymer together with an anionic material, e.g. silica-based particles, or anionic organic polymer, the clay may be added to the cellulosic suspension (stock) prior to, after or in between the addition of the drainage and retention aids, or together with any of the drainage and retention aids. The clay may also be added at several locations in the process, e.g. to the thick stock and again to the thin stock prior to the addition of drainage and retention aid.

The drainage and retention aid(s) according to the invention can be added to the stock to be dewatered in amounts which can vary within wide limits depending on, inter alia, type and number of components, type of cellulosic suspension, salt content, type of salts, filler content, type of filler, point of addition, degree of white water closure, etc. Generally, the retention and drainage aid(s) are added in amounts that give better drainage and/or retention than is obtained when not adding the components. The cationic polymer is usually added in an amount of at least about 0.001% by weight, often at least about 0.005% by weight, based on dry cellulosic suspension, and the upper limit is usually about 3% and suitably about 1.5% by weight. Commonly applied addition amounts of cationic polymer are from about 0.01% up to about 0.5% by weight. Anionic materials, e.g. anionic silica-based particles, anionic clays of the smectite type and anionic organic polymers, are usually added in an amount of at least about 0.001% by weight, often at least about 0.005% by weight, based on dry cellulosic suspension, and the upper limit is usually about 1.0% and suitably about 0.6% by weight.

When using an LMW cationic organic polymers in the process, they can be added in an amount of at least about 0.001% by weight, based on dry cellulosic suspension. Suitably, the amount is in the range of from about 0.07 up to about 0.5%, preferably in the range from about 0.1 up to about 0.35%. When using an aluminium compound in the process, the total amount introduced into the stock to be dewatered depends on the type of aluminium compound used and on other effects desired from it. It is for instance well known in the art to utilize aluminium compounds as precipitants for rosin-based sizing agents. The total amount added is usually at least about 0.05% by weight, calculated as $Al_2O_3$ and based on dry cellulosic suspension. Suitably the amount is in the range of from about 0.5 u to about 3.0%, preferably in the range from about 0.1 up to about 2.0%.

Further additives which are conventional in papermaking can of course be used in combination with the additive(s) according to the invention, such as, for example, dry strength agents, wet strength agents, optical brightening agents, dyes, sizing agents like rosin-based sizing agents and cellulose-reactive sizing agents, e.g. ketene dimers and succinic anhydrides, etc. The cellulosic suspension, or stock, can also contain mineral fillers of conventional types such as, for example, kaolin, china clay, titanium dioxide, gypsum, talc and natural and synthetic calcium carbonates such as chalk, ground marble and precipitated calcium carbonate.

Furthermore, the process can also be useful in the manufacture of paper from cellulosic suspensions having high conductivity. In such cases, the conductivity of the suspension that is dewatered on the wire is usually at least 1.0 mS/cm, suitably at least 2.0 mS/cm, and preferably at least 3.5 mS/cm. Conductivity can be measured by standard equipment such as, for example, a WTW LF 539 instrument supplied by Christian Berner. The values referred to above are suitably determined by measuring the conductivity of the cellulosic suspension that is fed into or present in the head box of the paper machine or, alternatively, by measuring the conductivity of white water obtained by dewatering the suspension. High conductivity levels mean high contents of salts (electrolytes) which can be derived from the materials used to form the cellulosic suspension, from various additives introduced into the cellulosic suspension, from the fresh water supplied to the process, etc. Further, the content of salts is usually higher in processes where white water is extensively recirculated, which may lead to considerable accumulation of salts in the water circulating in the process.

The present invention further encompasses paper making processes where white water is extensively recycled, or recirculated, i.e. with a high degree of white water closure, for example where from 0 to 30 tons of fresh water are used per ton of dry paper produced, usually less than 20, suitably less than 15, preferably less than 10 and notably less than 5 tons of fresh water per ton of paper. Recycling of white water obtained in the process suitably comprises mixing the white water with cellulosic fibres and/or optional fillers to form a suspension to be dewatered; preferably it comprises mixing the white water with a suspension containing cellulosic fibres, and optional fillers, before the suspension enters the forming wire for dewatering. The white water can be mixed with the suspension before, between, simultaneous with or after introducing the clay and optional drainage and retention aid(s) of this invention. Fresh water can be introduced in the process at any stage; for example, it can be mixed with cellulosic fibres in order to form a suspension, and it can be mixed with a thick suspension containing cellulosic fibres to dilute it so as to form a thin suspension to be dewatered, before, simultaneous with or after mixing the suspension with white water.

The invention is further illustrated in the following Examples which, however, are not intended to limit the same. Parts and % relate to parts by weight and % by weight, respectively, unless otherwise stated.

EXAMPLE 1

An Al—Mg clay having the $3R_2$ stacking (CC-14, Akzo Nobel Catalyst B.V.) was compared to a commercial talc (Finntalc P05 from Omya) in terms of pitch adsorption. The method of evaluation of pitch adsorption of mineral powder was a variation of a procedure outlined by D. A. Hughes in Tappi (July 1977, vol. 60, No. 7, p. 144-146). Firstly, samples of synthetic pitch were prepared by adding potassium hydroxide (1 M) to a mixture of 0.65 g of gum rosin and 0.35 g of oleic acid until saponification resulted. Denatured ethanol was subsequently added to dissolve the synthetic pitch.

Pitch adsorption test procedure: 35 ml of distilled water was first added to a glass centrifuge tube followed by the addition of 1 ml of the synthetic pitch solution and 10 ml of clay having the $3R_2$ stacking (2.5% dry content). The pH of the synthetic pitch slurry was adjusted to 6.5 with sulphuric acid. The mixture was subsequently stirred for 2 minutes and centrifuged for 20 minutes at 4500 rpm. The supernatant was thereafter poured off and discarded and the tube was dried over night at 60° C. After drying, the 10 ml of a chloroform-acetic anhydride (1:1) reagent was added to the tube and stirred to release the adsorbed pitch. The tube was then centrifuged for 20 minutes effecting that the clear reagent remained at the top of the tube. The reagent was thereafter poured into a small beaker and 10 drops of conc. sulphuric acid were added. After a period of 4 minutes the liquid was measured on an UV-vis spectrophotometer set at 400 nm whereby the absorbance value was compared to absorbance values of known quantities of pitch. Similar test was also performed for the sample of Finntalc P05. The pitch adsorption results are summarised in Table 1, in which 'Pitch Addition' refers to the amount of pitch, in mg, added per gram of adsorbent; talc or clay, and 'Pitch Adsorption' refers to the amount of pitch, in mg, adsorbed per gram of adsorbent; talc or clay.

TABLE 1

| | | Pitch Adsorption [mg/g] | | | |
|---|---|---|---|---|---|
| Test No. | Pitch Addition [mg/g] | Talc [0.16 mg/ml] | Clay (CC-14) [0.16 mg/ml] | Talc [0.08 mg/ml] | Clay (CC-14) [0.08 mg/ml] |
| 1 | 0 | 0 | 0 | 0 | 0 |
| 2 | 2 | 1.2 | 2 | 1.2 | 2 |
| 3 | 4 | 2.3 | 4 | 1.2 | 4 |
| 4 | 6 | 3 | 6 | 1.5 | 6 |
| 5 | 8 | 3.1 | 7.5 | 1.6 | 8 |
| 6 | 10 | 4 | 9 | 2 | 10 |
| 7 | 12 | 4.3 | 10 | 2.1 | 11.5 |
| 8 | 14 | 4.2 | 10.1 | 2.2 | 13 |
| 9 | 16 | 4.5 | 10.1 | 2 | 13 |
| 10 | 18 | 4.7 | 11 | 2.4 | 13 |

As shown by Table 1, the clay having the $3R_2$ stacking has a significantly improved adsorption capability as compared to talc.

EXAMPLE 2

In this example, the pitch adsorption characteristics of an Al—Mg cationic clay having the $3R_1$ stacking, (CC-8, Süd Chemie) was compared to an Al—Mg cationic clay having the $3R_2$ stacking (CC-17, Akzo Nobel Catalyst B.V.).

Two mixtures of synthetic pitch were prepared, one containing oleic acid and gum rosin (Pitch No. 1)—of example 1, and a further synthetic pitch mixture containing abietic acid. The abietic acid containing pitch (Pitch No. 2) was prepared by mixing 1 g of abietic acid and 1M potassium hydroxide until saponification occurred. Denaturated ethanol (250 ml) was added to dissolve the synthetic pitch. The same pitch adsorption test procedure as outlined in Example 1 was used. The results are summarized in Tables 1 and 2.

TABLE 2

| Test No. | Pitch Addition (Pitch No. 1) [mg/g] | Pitch Adsorption [mg/g] CC-8 ($3R_1$) | CC-17 ($3R_2$) |
|---|---|---|---|
| 1 | 0 | 0 | 0 |
| 2 | 8 | 5.4 | 7.1 |
| 3 | 16 | 9.64 | 14.1 |
| 4 | 32 | 21.5 | 29 |
| 5 | 48 | 34.4 | 41 |

TABLE 3

| Test No. | Pitch Addition (Pitch No. 2) [mg/g] | Pitch Adsorption [mg/g] CC-8 ($3R_1$) | CC-17 ($3R_2$) |
|---|---|---|---|
| 1 | 0 | 0 | 0 |
| 2 | 8 | 4.45 | 6.07 |
| 3 | 16 | 11.1 | 13.8 |
| 4 | 32 | 26.5 | 30.3 |
| 5 | 48 | 40.3 | 47.5 |

As shown by Tables 2 and 3, the clay with $3R_2$ stacking adsorbed abietic acid and the gum rosin as well as the oleic acid mixture to a significantly higher degree than the cationic clay having the $3R_1$ stacking.

EXAMPLE 3

The adsorption of stickies (hot-melts) of an Al—Mg cationic clay having the $3R_2$ stacking (CC-14, Akzo Nobel Catalyst B.V.) was compared to talc (Finntalc P05, Omya) using the TOC instrument (Dohrman DC190). The TOC (Total Organic Carbon) was determined by combustion at 800° C. whereby the carbon was oxidised to carbon dioxide and then analysed by means of the IR-spectroscopy method. The results are summarised in Table 4, in which 'Stickles Addition' refers to the amount of stickies, in mg, added per gram of adsorbent; clay or talc, and 'Stickies Adsorption' refers to the amount of stickles, in mg, adsorbed per gram of adsorbent; talc or clay.

TABLE 4

| Test No. | Stickies Addition [mg/g] | Stickies Adsorption [mg/g] Talc [0.16 mg/ml] hotmelt | CC-14 [0.16 mg/ml] hotmelt | Talc [0.08 mg/ml] hotmelt | CC-14 [0.08 mg/ml] hotmelt |
|---|---|---|---|---|---|
| 1 | 0 | 0 | 0 | 0 | 0 |
| 2 | 2 | 1.3 | 2 | 1.5 | 2 |
| 3 | 4 | 1.8 | 4 | 1.8 | 4 |

EXAMPLE 4

Drainage performance by incorporation of the clay having the $3R_2$ stacking in a dewatering and retention aid was evaluated by means of a Dynamic Drainage Analyser (DDA), available from Akribi Kemikonsulter AB, Sweden, which measures the time for draining a set volume of stock through a wire when removing a plug and applying vacuum (0.35 bar) to that side of the wire which is opposite to the side on which the stock is present. First pass retention was evaluated by means of a nephelometer by measuring the turbidity of the filtrate, the white water, obtained by draining the suspension.

The furnish used was based on a de-inking pulp from a newspaper mill having consistency of 30 g/liter, conductivity of around 1500 μS/cm and the pH of 7. Sample of an Al—Mg cationic clay having the $3R_2$ stacking (CC-9, Akzo Nobel. Catalyst B.V.) was added to the pulp suspension. The furnish was then mixed with a magnetic stirrer and the dwell/contact time of the stock and cationic clay was from 30 min. up to 1 hour. Thereafter the furnish was diluted with water (approx 1:10) before making the DDA test.

The stock/furnish samples were put into the baffled DDA-jar at time 0. Next the retention/dewatering chemicals were added in the following order: i) after 15 seconds 0.8 kg/ton of dry pulp of polyacrylamide (Eka PL 1510), ii) after another 15 seconds (30 seconds from the start) 0.4 kg/ton of dry pulp of anionic silica-based particles (Eka NP 780), iii) after another 15 seconds draining of the suspension while automatically recording the drainage time.

The filtrate samples from the drainage tests were evaluated with respect to the pitch adsorption. The adsorption was assumed to correlate to UV-vis spectrophotometer absorbance at 280 nm of the filtrate and the decrease in UV-vis absorbance was referred to as Pitch reduction. The results are set forth in Table 5.

TABLE 5

| Test No. | Addition of CC-9 [kg/t] | Drainage time [s] | Pitch reduction [%] |
|---|---|---|---|
| 1 | 0 | 9.3 | — |
| 2 | 5 | 6.04 | 19.8 |
| 3 | 10 | 5.63 | 21.4 |

Table 5 clearly shows that the addition of CC-9 to the suspension reduces the drainage time and that the filtrate contains less pitch as the CC-9 is added to the suspension.

EXAMPLE 5

In this example an Al—Mg cationic clay having the $3R_1$ stacking (CC-12) was compared to an Al—Mg cationic clay having the $3R_2$ stacking (CC-18) with respect to drainage.

The same furnish and procedure as described in Example 4 was used. Table 6 summarized the results.

TABLE 6

| Test No. | CC Dosage [kg/t] | Drainage time [sec.] CC-12 ($3R_1$) | CC-18 ($3R_2$) |
|---|---|---|---|
| 1 | 0 | 16.2 | 16.2 |
| 2 | 2 | 15 | 13.1 |
| 3 | 5 | 14.9 | 13.2 |
| 4 | 10 | 14.8 | 11.9 |

From table 6 it is evident that the addition of the clay having the $3R_2$ stacking further improves drainage compared to the cationic clay having the $3R_1$ stacking.

EXAMPLE 6

The drainage enhancing effect of the Al—Mg cationic clay having the $3R_2$ stacking (CC-22) was here evaluated. The same furnish and procedure as described in example 4 was used, except that different drainage and retention aids were used. In this example, 0.4 kg/ton of dry pulp of Percol 63 (a cationic polyacrylamide from CIBA) and 2 kg/ton of dry pulp of Hydrocol SW (bentonite clay of the smectite type from CIBA) were added in a similar manner.

TABLE 7

| CC Dosage [kg/t] | Drainage time [sec.] CC-22 ($3R_2$) |
|---|---|
| 0 | 11.2 |
| 2 | 9.1 |
| 10 | 8.1 |

Table 7 demonstrates that the performance of a dewatering and retention aid comprising addition of cationic PAM and bentonite clay to a suspension is improved by the addition of an Al—Mg cationic clay of the $3R_2$ type.

EXAMPLE 7

The adsorption of Pressure-Sensitive Adhesives stickies of an Al—Mg cationic clay having the $3R_2$ stacking (CC-17, Akzo Nobel Catalyst B.V.) was evaluated and compared with talc (Finntalc P05, Omya). Pressure-Sensitive Adhesives stickies are found in office waste furnishes as labels, tapes, self-sealing envelopes and Post-it® notes.

60 g of Post-it® notes having one side totally covered with the adhesive (Tappi journal vol. 79 no 7 July 1996) were cut into small squares and soaked in 1.5 l of cold tap water for 24 hours. 0.5 l of a salt solution containing $CaCl_2.2H_2O$, $Na_2SO_4.10H_2O$ and tap water was added to the water-paper mixture to simulate the paper mill conditions, such as pH and conductivity. The mixture was then disintegrated in a standard pulp disintegrator for 30000 revolutions. Fibres and fines larger than 25 um were removed by filtration. The filtrate was heated in a water bath to 60 C. The pH varied between 6.8 and 7.4. To the filtrate samples was added Al—Mg clay having a $3R_2$ stacking and Talc (PO5). After addition of CC-17 and talc the filtrate was mixed with a magnet stirrer and the dwell time of the CC-17 and talc was 60 min. The adsorption test was carried out by centrifugation 30 min 4500 rpm. The supernatant was then poured off and TOC was measured. Table 8 shows the results of adsorption of pressure sensitive adhesive.

TABLE 8

| Test No. | Talc [kg/t] | CC-17 [kg/t] | TOC [ppm] |
|---|---|---|---|
| 1 | 0 | 0 | 550 |
| 2 | 5 | | 525 |
| 3 | 10 | | 498 |
| 4 | 20 | | 400 |
| 5 | | 5 | 401 |
| 6 | | 10 | 292 |
| 7 | | 20 | 115 |

As shown by table 8, the adsorption of pressure sensitive adhesives is significantly improved when adding CC-17 compared to talc.

EXAMPLE 8

In this example, sizing performance was evaluated. A furnish from a liquid packaging board mill was treated with an Al—Mg cationic clay having the $3R_2$ stacking (CC-22, Akzo Nobel Catalyst B.V.) and with talc (Finntalc P05, Omya) respectively. Size and retention chemicals were added and hand sheets were made (SCAN-C 26:76). Sizing of the sheets was measured as Cobb 60 values (SCAN-P 12:64).

The furnish used was a thick-stock from a LPB mill, containing bleached soft- and hardwood pulp. This furnish was stirred and heated to 50° C. The chemicals were added and the furnish was treated for 30 minutes. The thick stock was then diluted with tap water to a consistency of 5 g/L. This furnish had a pH of 8 and a conductivity of 0.7 mS/cm. Before sheet making, 0.3 kg/ton of dry pulp of AKD (Keydime C223, Eka Chemicals), 8 kg/ton of dry pulp of cationic starch (Perlbond 970) and 0.5 kg/ton of dry pulp of silica-based particles (Eka NP 590, Eka Chemicals) were added. The sheets had a basis weight of approximately 73 $g/m^2$. Table 9 shows the sizing results obtained by addition of different amounts of talc and CC-22 to the liquid packaging board furnish.

TABLE 9

| Test No. | Talc [kg/t] | CC-22 [kg/t] | Cobb 60 |
|---|---|---|---|
| 1 | 0 | 0 | 40 |
| 2 | 1 | | 44 |
| 3 | 5 | | 60 |
| 4 | | 1 | 35 |
| 5 | | 5 | 34 |

The sizing performance improved when CC-22 was used over talc.

EXAMPLE 9

Sizing performance was evaluated with higher additions of Al—Mg cationic clay having the $3R_2$ stacking (CC-22, Akzo Nobel Catalyst B.V.) and talc (Finntalc P05, Omya), respectively. Hand sheets were made, and sizing was measured as Cobb 60 SCAN-P 12:64) values.

The furnish used was a thick stock from a LPB mill containing hydrogen peroxide bleached soft- and hardwood sulphate pulp at ~4% consistency. This furnish was stirred and heated to 50° C. Cationic clay or talc were added and the furnish was treated for 20 minutes. The thick stock was then diluted with bleach filtrate to ~3.9 g/l consistency. To the furnish AKD, 1.6 kg/t rosin size, 1.6 kg/t alum, 5.0 kg/t cationic starch and 0.35 kg/t silica-based particles (Eka NP 590, Eka Chemicals) were added before making hand sheets (Rapid-Köthen former). The sheets had a basis weight of approximately 100 g/m$^2$. Table 10 summarized the sizing results obtained by sizing the liquid packaging board furnish.

TABLE 10

| Test No. | AKD [kg/t] | Talc [kg/t] | CC-22 [kg/t] | COBB 60 |
|---|---|---|---|---|
| 1 | 0 | 0 | 0 | 258 |
| 2 | 0.5 | 0 | 0 | 250 |
| 3 | 0.8 | 0 | 0 | 131 |
| 4 | 1 | 0 | 0 | 59 |
| 5 | 1.4 | 0 | 0 | 39 |
| 6 | 0.5 | 5 | 0 | 211 |
| 7 | 0.8 | 5 | 0 | 115 |
| 8 | 1 | 5 | 0 | 61 |
| 9 | 1.4 | 5 | 0 | 39 |
| 10 | 0.5 | 0 | 10 | 198 |
| 11 | 0.8 | 0 | 10 | 87 |
| 12 | 1 | 0 | 10 | 45 |
| 13 | 1.4 | 0 | 10 | 33 |

Table 10 shows that the sizing performance was improved (lower Cobb 60 values) using CC-22 compared to talc.

EXAMPLE 10

This example was made in a pulp mill. Chemical pulp from the dewatering headbox of the pulp machine was treated with an Al—Mg cationic clay having the $3R_2$ stacking (CC-22, Akzo Nobel Catalyst B.V.). The turbidity of the pulp filtrate was then measured, see table 11.

The pulp used was a bleached eucalyptus fibre suspension at ~1.2% consistency. This pulp was stirred and heated at 60° C. The cationic clay was added and the pulp was treated for 30 minutes. The pulp was then filtrated through a Britt-Jar with a 200 mesh wire (76.2 μm hole diameters). The filtrate was analysed for turbidity in a Hach 2100P turbidity meter. Table 11 shows the results in terms of turbidity of the filtrate

TABLE 11

| Test No. | CC-22 [kg/t] | Turbidity [NTU] |
|---|---|---|
| 1 | 0 | 53 |
| 2 | 2 | 43 |
| 3 | 5 | 23 |

The turbidity of the filtrate improved (decreased) when treating a chemical pulp with CC-22.

EXAMPLE 11

This example was made in a TMP pulp mill. Thenmomechanical pulp (TMP) was dewatered or washed after hydrogen peroxide bleaching. The filtrate is often referred to as bleach filtrate. TMP bleach filtrate water was stirred and heated at 50° C. The TMP bleach filtrate water was treated for 30 minutes with an Al—Mg cationic clay having the $3R_2$ stacking (CC-22, Akzo Nobel Catalyst B.V.). This water was centrifuged and the dear phase was measured for turbidity by being analysed for absorption in a Lasa 10 spectrophotometer at 700 nm wavelength. Table 12 shows the results.

TABLE 12

| Test No. | CC-22 [kg/t] | Absorption [700 nm] |
|---|---|---|
| 1 | 0 | 0.506 |
| 2 | 10 | 0.377 |

The absorption in the clear phase improved (decreased) when treating TMP bleach water with CC-22.

EXAMPLE 12

This example was made in a de-inked pulp (DIP) mill. Pulp from the DIP plant was treated with an Al—Mg cationic clay having the $3R_2$ stacking (CC-22, Akzo Nobel Catalyst B.V.). The turbidity of the pulp filtrate was then measured, see table 13.

The pulp used was a taken from between the disc filter and the screw press in the DIP plant. The pulp had a consistency of ~7%, and was diluted with tap water to ~4.2%. This pulp was stirred and heated at 50° C. The clay was added and the pulp was treated for 30 minutes. The pulp was then filtrated through a GF/A glass fibre filter (~2 μm hole diameters). The filtrate was analysed for turbidity in a Hach 2100P turbidity meter. Table 13 shows the results.

TABLE 13

| Test No. | CC-22 [kg/t] | Turbidity [NTU] |
|---|---|---|
| 1 | 0 | 71.8 |
| 2 | 2 | 63.5 |
| 3 | 5 | 42.3 |

The turbidity of the filtrate improved (decreased) when mixing de-inked pulp with CC-22 before filtering.

EXAMPLE 13

Pulp from a de-inked pulp (DIP) mill was treated with an Al—Mg cationic clay having the $3R_2$ stacking (CC-22, Akzo Nobel Catalyst B.V.) in a manner similar to Example 12. The turbidity of the pulp filtrate was then measured and is summarized in Table 14.

TABLE 14

| test | CC-22 [kg/t] | Turbidity [NTU] |
|---|---|---|
| 1 | 0 | 18 |
| 2 | 5 | 15 |
| 3 | 10 | 11 |

The turbidity of the filtrate improves (decreases) when treating a de-inked pulp by adding CC-22 to it before filtering.

The invention claimed is:

1. A cellulosic product comprising clay having $3R_2$ stacking.

2. The product according to claim 1, wherein the product is paper.

3. The product according to claim 1, wherein the product is pulp.

4. The product according to claim 1, wherein the clay is cationic.

5. The product according to claim 1, wherein the clay comprises layers and interlayers, said interlayers comprising anions, and said layers comprising divalent and trivalent metal atoms in such a ratio that the overall charge of said layers are cationic.

6. The product according to claim 1, wherein the divalent metal atom is magnesium and the trivalent metal ion is aluminium.

7. The product according to claim 1, wherein the interlayers comprise anions selected from the group consisting of $NO_3^-$, $OH^-$, $Cl^-$, $Br^-$, $I^-$, $CO_3^{2-}$, $SO_4^{2-}$, $SiO_3^{2-}$, $CrO_4^{2-}$, $BO_3^{2-}$, $MnO_4^-$, $HGaO_3^{2-}$, $HVO_4^-$, $ClO_4^-$, pillaring or intercalating anions, carboxylates, sulphonates and mixtures thereof.

8. The product according to claim 1, wherein the interlayers comprise hydroxide, carbonate or mixtures thereof.

9. The product according to claim 1, wherein the clay is characterized by the general formula:

$$[M_m^{2+}M_n^{3+}(OH)_{2m+2n}]X_{n/z}^{Z-}bH_2O,$$

wherein m and n, independently of each other, are integers having a value such that m/n is in the range of from 1 up to 10; b is an integer having a value in the range of from 0 to 10; z is an integer from 1 to 10, $X_{n/z}^{Z-}$ is an anion where z is an integer from 1 to 10; $M^{2+}$ is a divalent metal atom selected from the group consisting of Be, Mg, Cu, Ni, Co, Zn, Fe, Mn, Cd, Ca and mixtures thereof; and $M^{3+}$ is a trivalent metal atom selected from the group consisting of Al, Ga, Ni, Co, Fe, Mn, Cr, V, Ti, In and mixtures thereof.

10. The product according to claim 1, wherein the clay is selected from the group consisting of hydrotalcite, manasseite, pyroaurite, sjögrenite, stichtite, barbertonite, takovite, reevesite, desautelsite, motukoreaite, wermlandite, meixnerite, coalingite, chloromagalumite, carrboydite, honessite, woodwardite, iowaite, hydrohonessite, mountkeithite, and mixtures thereof.

* * * * *